US010376010B2

(12) United States Patent
Allen et al.

(10) Patent No.: US 10,376,010 B2
(45) Date of Patent: Aug. 13, 2019

(54) SHOCK ABSORBING HELMET

(71) Applicant: Bell Sports, Inc., Scotts Valley, CA (US)

(72) Inventors: Scott R. Allen, Scotts Valley, CA (US); James R. Penny, Santa Cruz, CA (US); Alexander J. Szela, Santa Cruz, CA (US); Julio Valencia, Santa Cruz, CA (US); Christopher T. Pietrzak, Ben Lomond, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 280 days.

(21) Appl. No.: 15/342,052

(22) Filed: Nov. 2, 2016

(65) Prior Publication Data

US 2017/0119080 A1 May 4, 2017

Related U.S. Application Data

(60) Provisional application No. 62/250,967, filed on Nov. 4, 2015.

(51) Int. Cl.

| | |
|---|---|
| ***A42B 1/06*** | (2006.01) |
| ***A42B 3/00*** | (2006.01) |
| ***A42B 3/12*** | (2006.01) |
| ***A42B 3/28*** | (2006.01) |
| ***A42B 3/06*** | (2006.01) |
| ***A42B 3/32*** | (2006.01) |

(52) U.S. Cl.

CPC ..... *A42B 3/125* (2013.01); *A42B 3/064* (2013.01); *A42B 3/12* (2013.01); *A42B 3/28* (2013.01); *A42B 3/283* (2013.01); *A42B 3/32* (2013.01)

(58) Field of Classification Search

CPC ..... A42B 3/125; A42B 3/064; A42B 3/12; A42B 3/28; A42B 3/283; A42B 3/32; A42B 3/00; A42B 3/06; A42B 3/066; A42B 3/324; A42B 3/14; A63B 71/10

USPC ..... 2/410–412, 414, 418, 420, 425

See application file for complete search history.

(56) References Cited

U.S. PATENT DOCUMENTS

| | | | | |
|---|---|---|---|---|
| 3,956,773 | A * | 5/1976 | Chisum | A42B 3/124 2/414 |
| 4,024,587 | A | 5/1977 | Barford | |
| 4,573,222 | A | 3/1986 | Zago | |
| 4,598,430 | A | 7/1986 | Nava | |

(Continued)

FOREIGN PATENT DOCUMENTS

| | | |
|---|---|---|
| DE | 10201122796 | 7/2013 |

*Primary Examiner* — Jameson D Collier

(74) *Attorney, Agent, or Firm* — Booth Udall Fuller, PLC

(57) ABSTRACT

A helmet can include an outer shell including a faceport, a first segment including a longitudinal ridge extending from a front of the helmet to a rear of the helmet, a gap disposed along the edge of the first segment, and a second segment offset from the first segment by the gap. A hinged zone can be formed by an elastomeric material disposed within the gap and coupled to the first segment and the second segment of the outer shell. The hinged zone can elastically flex in a radial direction towards a center of the helmet. An energy absorbing liner can be coupled to an inner surface of the outer shell, and an open space can be formed between an inner surface of the hinged zone and an outer surface of the energy absorbing liner.

20 Claims, 5 Drawing Sheets

(56) References Cited

U.S. PATENT DOCUMENTS

| | | | | | |
|---|---|---|---|---|---|
| 5,544,367 | A | * | 8/1996 | March, II | A42B 3/00 2/410 |
| 5,615,419 | A | * | 4/1997 | Williams | A42B 3/00 2/411 |
| 5,661,854 | A | * | 9/1997 | March, II | A42B 3/00 2/410 |
| 6,088,840 | A | * | 7/2000 | Im | A42B 3/00 2/411 |
| 6,154,889 | A | * | 12/2000 | Moore, III | A42B 3/06 2/411 |
| 6,339,849 | B1 | * | 1/2002 | Nelson | A42B 3/00 2/411 |
| 6,381,760 | B1 | | 5/2002 | Lampe et al. | |
| 8,850,622 | B2 | | 10/2014 | Finiel et al. | |
| 2013/0263363 | A1 | * | 10/2013 | Pietrzak | A42B 3/28 2/411 |
| 2015/0113718 | A1 | | 4/2015 | Bayer | |
| 2015/0282550 | A1 | | 10/2015 | Musal | |

* cited by examiner

SHOCK ABSORBING HELMET

RELATED APPLICATIONS

This application claims the benefit of U.S. provisional patent application 62/250,967, filed Nov. 4, 2015 titled "Shock Absorbing Helmet," the entirety of the disclosure of which is incorporated by this reference.

TECHNICAL FIELD

This disclosure relates to a helmet comprising shock absorbing structures. The shock absorbing helmet can be employed wherever a conventional helmet is used with additional benefits as described herein, including in down hill skiing and absorbing shock from ski gate impacts.

BACKGROUND

Protective headgear and helmets have been used in a wide variety of applications to prevent damage and injury to a user's head and brain. Damage and injury to a user can be prevented or reduced by helmets that prevent hard objects or sharp objects from directly contacting the user's head, as well as by managing energy of an impact.

SUMMARY

A need exists for an improved helmet and shock absorbing. Accordingly, in an aspect, a helmet can comprise an outer shell comprising a faceport, a first segment comprising a longitudinal ridge extending from a front of the helmet to a rear of the helmet, a gap disposed along the edge of the first segment, and a second segment comprising an upper portion offset from an upper side of the first segment by the gap and a lower portion of the second segment offset from a lower side of the first segment by the gap. A hinged zone can be formed by an elastomeric material disposed within the gap and coupled to the first segment and the second segment of the outer shell, the hinged zone elastically flexing in a radial direction towards a center of the helmet. An energy absorbing liner can be coupled to an inner surface of the outer shell. An open space can be formed between an inner surface of the hinged zone and an outer surface of the energy absorbing liner.

The helmet can further comprise the gap comprising a width in a range of 3-30 millimeters (mm) and providing the offset between the upper side of the first segment and the upper portion of the second segment, as well as the offset between the lower side of the first segment and the lower portion of the second segment. The first segment can comprise a U-shape with a base of the U-shape extending along a top edge of the faceport and legs of the U-shape extending to a rear of the helmet along opposing right and left sides of the outer shell. The energy absorbing liner can comprise an inner surface oriented towards a space for receiving a head of a user and the outer surface of the energy absorbing layer can be opposite the inner surface, the outer surface of the energy absorbing layer being directly attached to the second segment of the outer shell, and the outer surface of the energy absorbing layer being offset from an inner surface of the longitudinal ridge by the open space. The hinged zone can comprise the longitudinal ridges coupled to the second segment of the outer shell with the elastomeric material elastically deforming in a range of 1-20 mm through the open space towards the energy absorbing liner to reduce energy transferred from the outer shell to the energy absorbing liner. The longitudinal ridges can comprise peaks and the open spaces can comprise a height in a range of 5-40 mm when at rest. The elastomeric material can be formed as a strip comprising a thickness in a range of 1-10 mm.

In another aspect, a helmet can comprise an outer shell comprising a first segment extending from a front of the helmet to a rear of the helmet, a gap disposed along the edge of the first segment, and a second segment offset from the first segment. A hinged zone can be formed by an elastomeric material disposed within the gap and coupled to the first segment and the second segment of the outer shell, the hinged zone being elastically deformable. An energy absorbing liner can be coupled to an inner surface of the outer shell. An open space can be formed between an inner surface of the hinged zone and an outer surface of the energy absorbing liner.

The helmet can further comprise the gap comprising a width in a range of 3-30 mm and providing the offset between the upper side of the first segment and the upper portion of the second segment, as well as the offset between the lower side of the first segment and the lower portion of the second segment. The first segment can comprise a U-shape with a base of the U-shape extending along a top edge of a faceport and legs of the U-shape extending to a rear of the helmet along opposing right and left sides of the outer shell. The energy absorbing liner can comprise an inner surface oriented towards a space for receiving a head of a user and the outer surface of the energy absorbing layer can be opposite the inner surface, the outer surface of the energy absorbing layer being directly attached to the second segment of the outer shell, and the outer surface of the energy absorbing layer being offset from an inner surface of the first segment by the open space. The first segment, elastomeric material, and open space together can form a hinged zone in which the hinged zone elastically flexes in a range of 1-20 mm towards the energy absorbing liner in a radial direction toward a center of the helmet to reduce energy transferred from low-energy impacts through the outer shell to the energy absorbing liner. A longitudinal ridge can be formed on the first segment of the outer shell comprising peaks and the open spaces can comprise a height in a range of 5-40 mm when at rest. The elastomeric material can be formed as a strip comprising a thickness in a range of 1-10 millimeters.

In another aspect, the helmet can comprise an outer shell, a hinged zone formed by an elastomeric material being coupled to a portion of the outer shell, an energy absorbing liner coupled to an inner surface of the outer shell, and an open space formed between an inner surface of the hinged zone and an outer surface of the energy absorbing liner.

The helmet can further comprise a first segment extending from a front of the helmet to a rear of the helmet, a gap disposed along the edge of the first segment, and a second segment offset from the first segment, wherein the elastomeric material can be disposed within the gap and can be coupled to the first segment and the second segment of the outer shell. The energy absorbing liner can comprise a cellular material for absorbing maximum test standard energies upon accidental impact. The first segment can comprise a U-shape with a base of the U-shape extending along a top edge of a faceport and legs of the U-shape extending to a rear of the helmet along opposing right and left sides of the outer shell. The energy absorbing liner can comprise an inner surface oriented towards a space for receiving a head of a user and the outer surface of the energy absorbing layer can be opposite the inner surface, the outer surface of the energy absorbing layer being directly attached to a second segment of the outer shell, and the outer surface of the energy absorbing layer being offset from an inner surface of a first segment of the outer shell by the open space. The hinged zone can comprise a ridge that elastically deforms in a range of 1-20 mm through the open space towards the energy absorbing liner to reduce energy transferred from the outer shell to the energy absorbing liner.

DETAILED DESCRIPTION

Figure 1A:
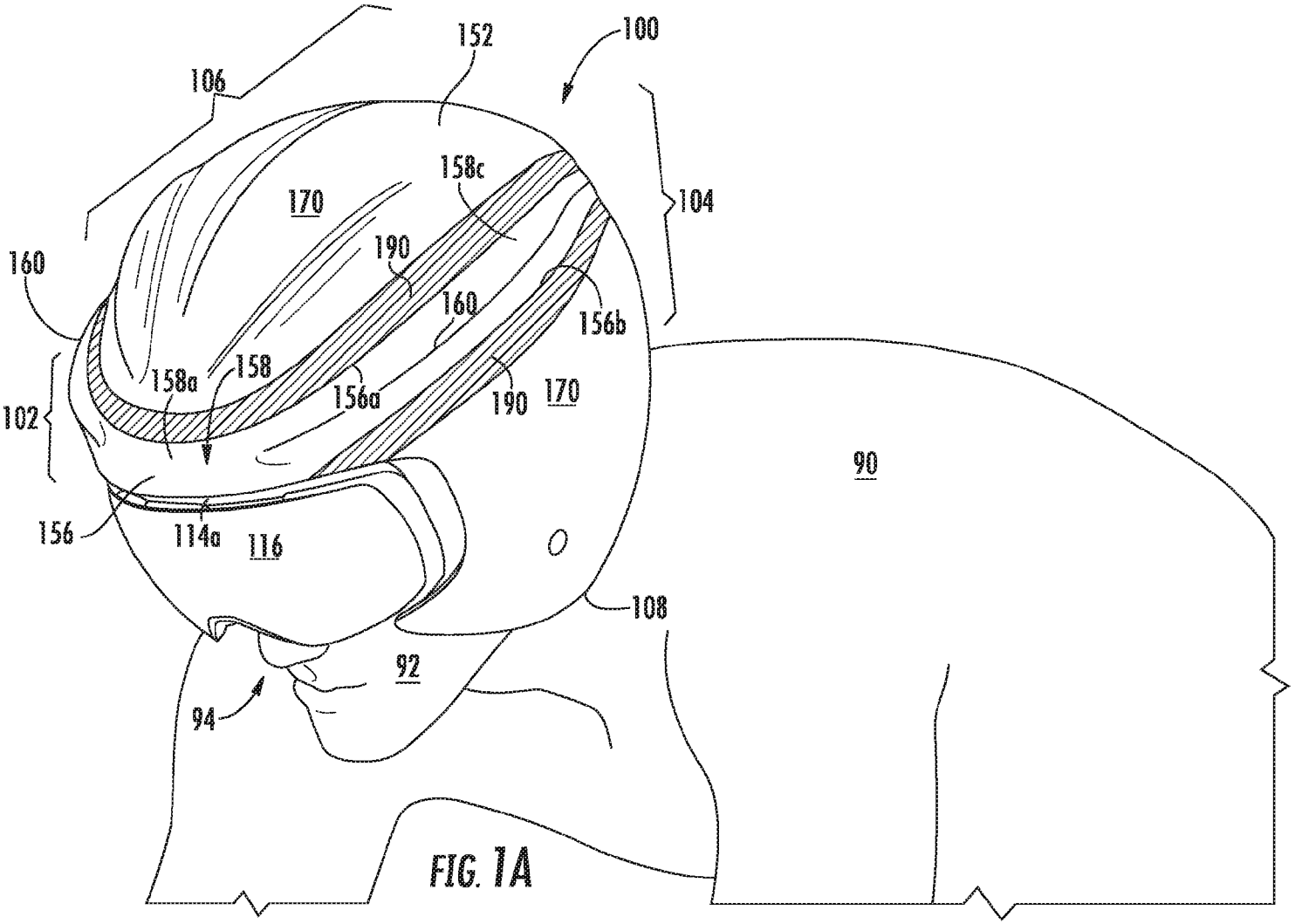
FIGS. 1A-1C show various views of an embodiment of a shock absorbing helmet.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments of helmets for recreational activities and/or activities wherein the wearer of the helmet is at risk of a head injury, from impact or other trauma. For example, the disclosures described herein may be applied to ski/snowboard helmets, cycling helmets, wakeboard/water ski helmets, skateboard helmets, and other protective helmets, such as protective helmets for hockey players, football players, baseball players, lacrosse players, polo players, climbers, sky divers, or any other athlete in a sport. However, the disclosure is presented with the understanding that the disclosure is to be considered as an exemplification of the principles of the disclosed methods and systems, and is not intended to limit the broad aspect of the disclosed concepts to the embodiments illustrated. Other industries also use protective headwear, such that individuals employed in other industries and work such as construction workers, soldiers, fire fighters, pilots, or types of work and activities can also use or be in need of a safety helmet, where similar technologies and methods can also be applied.

Generally, protective helmets, such as the protective helmets listed above, can comprise an outer shell and in inner energy-absorbing material. For convenience, protective helmets can be generally classified as either in-molded helmets or hard shell helmets. In-molded helmets can comprise one layer, or more than one layer, including a thin outer shell, an energy-absorbing layer or impact liner, and a comfort liner or fit liner. Hard-shell helmets can comprise a hard outer shell, an impact liner, and a comfort liner. The hard outer shell can be formed by injection molding and can include Acrylonitrile-Butadiene-Styrene (ABS) plastics or other similar or suitable material. The outer shell for hard-shell helmets is typically made hard enough to resist impacts and punctures, and to meet the related safety testing standards, while being flexible enough to deform slightly during impacts to absorb energy through deformation, thereby contributing to energy management. Hard-shell helmets can be used as skate bucket helmets, motorcycle helmets, snow and water sports helmets, football helmets, batting helmets, catcher's helmets, hockey helmets, and can be used for BMX riding and racing. While various aspects and implementations presented in the disclosure focus on embodiments comprising in-molded helmets, the disclosure also relates and applies to hard-shell helmets.

FIG. 1A shows a perspective view of a user 90 wearing a non-limiting embodiment of a shock absorbing or shock dampening helmet 100. The helmet 100 comprises a front portion 102 that can be disposed or positioned at or near a face or front 92 of the user 90 when the helmet 100 is worn by the user 90. A rear or back 104 of the helmet 100 is disposed opposite the front 102, and can be disposed or positioned at, over, or near the back or rear of a head 94 of the user, including the occipital curve of the user's head 94. The helmet 100 comprises a top or top portion 106 that covers a top of the user's head 94 when the helmet 100 is worn by the user 90. The helmet 100 also comprises a bottom or bottom edge 108, opposite the top 106, that defines a lower or bottom portion of the helmet 100. The helmet 100 can also include a right side 110 disposed between the front 102 and rear 104 of the helmet, that aligns with or is disposed at or over a right side of the user's head 94 when the helmet 100 is worn. The helmet 100 can also comprise a left side 112, opposite the right side 110, that can be disposed between the front 102 and rear 104 of the helmet, and align with or be disposed at or over a left side of the user's head 90 when the helmet 100 is worn. A faceport 114 can be formed in the front of the helmet 100 for the user's face, the faceport being defined by an opening in the energy management layer 130 or the outer shell 150. In some instances a visor, lens, or face shield 116 can be disposed within the faceport 114 and coupled to the helmet 100.

The outer shell 150 can, without limitation, be formed of a plastic, resin, fiber, or other suitable material including polycarbonate (PC), polyethylene terephthalate (PET), acrylonitrile butadiene styrene (ABS), polyethylene (PE), polyvinyl chloride (PVC), vinyl nitrile (VN), fiberglass, carbon fiber, or other similar material. The outer shell 150 can be stamped, in-molded, injection molded, vacuum formed, or formed by another suitable process. Outer shell 150 can provide a shell into which the energy management layer 130 can be in-molded. Outer shell 150 can also provide a smooth aerodynamic finish, a decorative finish, or both, for improved performance, improved aesthetics, or both. As a non-limiting example, the outer shell 150 can comprise a PC shells that are in-molded in the form of a vacuum formed sheet, or are attached to the energy management layer 130.

The outer shell 150 can be coupled to the energy management layer, using any suitable chemical or mechanical fastener or attachment device or substance including without limitation, an adhesive, permanent adhesive, pressure sensitive adhesive (PSA), foam-core adhesive, tape, two-sided tape, mounting foam adhesive, fastener, clip, cleat, cutout, tab, snap, rivet, hog ring, or hook and loop fasteners.

The outer shell 150 can comprise an outer surface 152 that is oriented away from an interior of the helmet 100 and away from the head 94 of the user 90. The outer shell 150 can further comprise an inner surface 154 opposite the outer surface 152 that is oriented towards the interior of the helmet 100 and toward the head 94 of the user 100. The outer shell 150 can further comprise a first segment 156 that extends from a front 102 of the helmet 100 to a rear 104 of the helmet 100. The first segment 156 can be smaller than a second segment 170, a relative size being measured by surface area, volume, or mass. The first segment 156 can also comprise a longitudinal ridge or peak 160 formed along a length of the first segments 156, such as an entirety of the length or a portion of the length less than the entirety, the ride or peak 160 extending from a front 102 of the helmet 100 to a rear 104 of the helmet 100. The first segment 156 can be formed comprising a U-shape 158, in which a base 158*a* of the U-shape 158 extends along a top edge 114*a* of the faceport 114 and right and left legs 114*b*, 114*c* of the U-shape 114 extend to a rear 104 of the helmet 100 along the opposing first or right side 110 and the second or left side 112 of the outer shell 150, respectively.

The helmet 100 can also comprise a gap, channel, or offset 164 that extends completely through the outer shell 150 from the outer surface 152 to the inner surface 145, and is disposed along an edge of the first segment 156. The gap 164 can extend between the first segment 156 of the outer shell 150 and the second segments 170 of the outer shell 170. While the outer shell is, for convenience, described with respect to first segment 156 and second segment 170, additional segments, such as three, four, or any desired number of helmet segments can also be used. As shown throughout the FIGs., including at FIGS. 2A and 2B, the second segment 170 of the outer shell 150 can comprise and upper portion 172 and a lower portion 174. The upper portion 172 of the second segment 170 can be offset from an upper side or upper edge 156*a* of the first segment 156 by the gap 164. Similarly, the lower portion 174 of the second segment 170 can be offset from a lower side or lower edge 156*b* of the first segment 156 by the gap 164. The gap 164 can comprise a width W, or a distance between the upper side 156*a* and the upper portion 172 of the second segment 170. The width W of the gap 164 can also be the distance or offset between the lower side 156*b* and the lower portion 174 of the second segment 170. The width W can be constant, substantially constant, or vary along the length of the gap 164, the length of the gap 164 being measured in a direction perpendicular to the gap 164. In some instances, the width W can be in a range of 3-30 mm, 4-20 mm, or 5-15 mm.

The first segment 156 of the outer shell 150 can be formed to include one or more longitudinal ridges 160 that extend along a length of the first segment 156, such as along right leg 158*b* of U-shape 158 or along right leg 158*c* of U-shape 158. The longitudinal ridges 160 can comprise ridges or peaks that form open zones or open spaces 180, the ridges 160 comprising a height H, 200, shown in FIG. 3B, where the height H, 200 can be in a range of 3-40 mm, 3-30 mm, 3-20 mm, 3-10 mm, 1-5 mm, or thereabouts.

A hinged zone, bumper zone, or crumple zone 178 can be formed by an elastomeric material 190 being disposed within the gap 164 and coupled to the first segment 156 and the second segment 170 of the outer shell 150. The elastomeric material 190 may comprise any material known in the art adapted or configured to elastically bend responsive to a force applied to the elastomeric material and reform when the force is no longer applied to the elastomeric material. The elastomeric material 190 may comprise one or more layers of rubber, thermoplastic polyurethane (TPU), thermoplastic rubber (TPR), fabrics, LYCRA®, a type of spandex/elastane fiber, and the like, or any combination thereof, but is not limited thereto. The elastomeric material 190 can be formed as a strip comprising a width equal or substantially equal to the width W of the gap 164, and in some instances may be in a range of 3-30 mm and comprise a thickness T in a range of 1-10 mm, 1-5 mm, 1-3 mm, or thereabouts. The elastomeric material 190 can be coupled to the upper side 156*a* of the first segment 156 of outer shell 150 and the lower side 156*b* of the first segment 156 as well as adjacent edges of the upper portion 172 of the second segments 170 and the lower portion 174 of the second segment 170 to join or hold the segments 156, 170 of the outer shell 150 together. The elastomeric material 190 may be coupled to the outer shell 150 with an adhesive, co-molding, over-molding, and the like. According to some aspects, each strip or portion of the elastomeric material 190 can follow an arc or contour of the outer shell 150 adjacent the elastomeric material 190.

As such, the elastomeric material 190 can facilitate or maintain the spacing or gap 164, rather that direct contact among segments of the outer shell. With the elastomeric material 190 disposed within the gap 164, a size of the gap 164 can also change during impact or an energy management event to provide for movement of the hinged zone 178 and act as a pivot point or hinge for the hinged zone 178. Thus, the hinged zone 178 can also act as a bumper of sorts. In instances where the helmet 100 will undergo a penetrator test during certification, such as when helmet 100 is snow helmet or a motorcycle helmet, the elastomeric material 190 can prevent the penetrator from passing beyond the outer shell 150 through the gaps 164 between segments of the outer shell 150, without being resisted.

The thickness T and the width W of the elastomeric material 190 can be sized such that the width W is not too wide and does not allow a penetrator from a penetrator test to get through the helmet 100 so that the helmet 100 fails the penetrator test. A width W can be sized such that it is not too narrow and provides too little flex or elastic movement to absorb energy transferred to the hinged zone 178. Additionally, a width and thickness are not made too great, so as to avoid making the helmet 100 too heavy, the elastomeric material 190 being denser and heavier than other materials used for the energy absorbing material 130 and the outer shell 150. As such, the hinged zone can comprise, or be formed of, first and second materials. The first material can be the first segment 156 of outer shell 150 or ridge 160, and the second material can be the elastomeric material 190 coupled to, and facilitating movement of, the first material, wherein the second material is more flexible than the second material.

An energy absorbing liner or energy management layer, or impact foam 130 can be disposed within, and coupled to, an inner surface 154 of the outer shell 150. The energy absorbing layer 130 can be made of plastic, polymer, foam, or other suitable energy-absorbing material to absorb, deflect, or otherwise manage energy and to contribute to energy management for protecting the user 90 during impacts. The energy management layer 130 can include, without limitation, expanded polystyrene (EPS), expanded polypropylene (EPP), expanded polyurethane (EPU), expanded polyolefin (EPO), ethylene vinyl acetate (EVA), or other suitable material. If an in-molded helmet, the helmet 100 can be formed with the outer shell 150 being directly bonded, in certain locations, to the energy absorbing layer 130 by expanding foam into the outer shell 150. As such, the energy absorbing layer 130 can, in some embodiments, be in-molded into outer shell 150. Alternatively, in other embodiments the energy absorbing layer 130 can be formed and subsequently coupled, in multiple portions, to the outer shell 150. In any event, the energy absorbing layer 130 can absorb energy from an impact by bending, flexing, crushing, or cracking.

The energy absorbing liner 130 can comprise an inner surface 134 oriented towards a center 184 of the helmet, or a space within the helmet 100 for receiving the head 94 of the user 90 and the outer surface 132 of the energy absorbing layer 130 being opposite the inner surface 134, the outer surface 132 of the energy absorbing layer 130 being directly attached to the second segment 170 of the outer shell 150, and the outer surface 132 of the energy absorbing layer 130 being offset from an inner surface 154 of the first segment 156 or of the longitudinal ridge 160 by the open space 180.

The open space 180 can be formed between the inner surface 179 of the hinged zone 178 (e.g., the inner surface 154 of the outer shell and the inner surface of the elastomeric material 190) and the outer surface 132 of the energy absorbing layer 130. More specifically, the open space 180 can be formed between an inner surface 179 of the hinged zone 178 and the outer surface 132 of the energy absorbing liner 130. The open space 180 can be a void or can also be filled with other energy absorbing or dampening materials that still allow for, and facilitate, the movement of hinged zone 178.

The hinged zone 178 can comprise the first segment 156 of the outer shell 150, including the ridges 160, and the elastomeric material 190. The hinged zone 178 can elastically flex or deform in a radial direction towards a center 184 of the helmet 100 by extending into the open space 180 or by changing a size, shape, or both a size and shape of the open space 180 by compressing, moving, flexing, or deforming the hinged zone 178. The hinged zone 178, including the first segment of the outer shell 156 and the elastomeric material 190, can elastically flex or deform be in a range of 1-20 mm, 1-10 mm, 1-5 mm, 1-2 mm, or thereabouts towards the energy absorbing liner 130 in a radial direction towards the center 184 of the helmet 100 to reduce energy transferred from the outer shell 150 to the energy absorbing 130. The center 184 of the helmet can be a centroid or center of mass of the helmet 100, or center of a space for receiving head 94 of user 90.

The hinged zone 178 can reduce energy transfer to the head 94 of the user 90 from low energy impacts, such as impacts on a snow helmet from a ski gate, wand, or marker. The reduction in energy transfer to the head 94 can occur without engaging the primary energy management material 130 of the helmet 100, which is engaged in high energy impacts, relying instead on the movement, flexing, and deformation of the hinged zone 178 into the open space 180. By separating the outer shell 150 from the inner energy absorbing material 130, as well as positioning the hinged zone 178 on the helmet 100 where high frequency, low energy impacts are most likely occur, the hinged zone 178 can work like a shock absorber on a car (and can also be referred to as, "Segmented Shell Bumper Technology™"). The hinged zones 178 can be isolated from the rest of the helmet 100 by elastomeric material 190 where the hinged zones 178, including the first segment 156 of the outer shell 150, can repeatedly take or absorb impacts, by mechanically and elastically deforming, without damaging or compromising the inner energy management material 130, and further reduce energy transferred from low energy impacts to the user 90. To the contrary, conventional ski helmets typically transfer energy directly from an outer shell of the helmet to the energy management material (or inner shell) of the helmet and the user.

For example, conventional helmets, like conventional snow helmets, typically transfer energy directly from the outer shell of the helmet to the energy management material (or inner shell) of the helmet. With smaller, multi-impact scenarios having lower levels of kinetic energy, the kinetic energy can be too low to be substantially absorbed by the main helmet or energy absorbing liner, resulting in a same or similar multi-impact energy being passed directly to the wear's head, brain, or both, which can result in concussions. Moreover, some helmet main liner material or energy absorbing material, such as but not limited EPS, are easily damaged or deformed by repetitive low energy impacts that leave them vulnerable to fully absorbing and protecting the wearer during maximum test standard impact energies. Many conventional helmet energy liners by design include a material of cellular structure, thickness and shape configured to absorb maximum test standard energies upon accidental impact. Thus, conventional helmet designs can leave users susceptible to multiple low-energy impacts resulting from the repeated low energy collisions, such as ski gates striking a ski helmet.

To the contrary, the helmet 100 comprising hinged zones 178, provide helmet systems and methods adapted to reduce energy transfer to the head from impacts, such as, but not limited to, ski gate impacts, without directly engaging the energy absorbing liner 130 of the helmet 100 by non-elastic or plastic deformation, such as by crushing or collapsing. The reduction of energy transfer to the head 94 of the user 90 can be accomplished without changing or modifying the energy management material 130, or changing the energy management layer 130 away from a foam type materials that can be used to effectively manage collision energies or high collision energies by being crushed, collapsed, or breaking. Engagement of the layer 130 can be avoided, minimized, or reduced by forming the outer shell 150 with living bumper zones, crumple zones, or hinged zones 178, which absorb and dissipate energy of a lower energy value than that which would normally "activate" or plastically deform the helmet liner 130. According to some aspects, at least portions of the outer shell 150, such as first segment 156 including ridges 160, are separated from the inner energy absorbing liner 130. For example, the helmet 100 may comprise one or more open zones 180 disposed between the outer shell 150 and the energy management material 130. The ridges 160 and open zones 180 may be positioned on the helmet 100 where impacts are most likely to occur, thus acting as shock absorbers on the helmet 100. More particularly, the open zones 180 may be isolated from the rest of the helmet 100 by an elastomeric material 190, such that the helmet 100 may mechanically receive or absorb impacts repeatedly without damaging the energy absorbing liner 130, and by reducing energy transferred through the energy absorbing liner 130 to a head 94 of the user 90.

Furthermore, when only a segment of the outer shell 150 is impacted, such as first segment 156 or second segment 170, rather than an entire, unitary, or integrally formed outer shell, a force or energy of the impact on the segment of the shell has been discovered in some instances to be transferred to the energy absorbing liner 130 in a smaller area. Concentrating impact energy, such as high energy impacts from collisions, can cause more of the energy absorbing liner 130 to be crushed or plastically deformed, such as when the energy absorbing liner 130 is formed of foam or crushable materials, like for example EPS. A concentrated area of the energy absorbing liner 130 being crushed can cause deformation or crushing of the energy absorbing liner 130 to occur at deeper levels, which, all things being equal, requires more time for the deformation and crushing to occur, which in turn desirably reduces or lowers the energy that reaches the brain or head 94 of the user 90. Similarly, when impact energies occur or are concentrated on the elastomeric material 190 disposed in the gaps 164, more of the energy absorbing liner 130 can be plastically deformed or crushed, thereby reducing or attenuating an amount or pattern of energy arriving at the head 94 of the user 90.

Figure 1B:
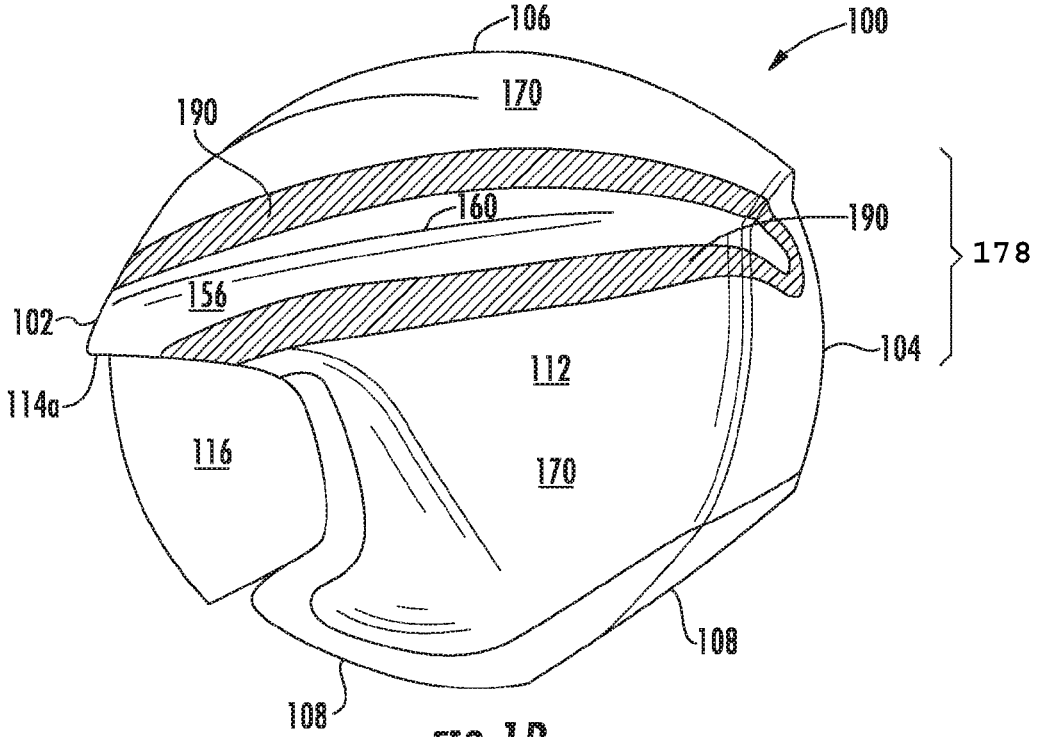

FIG. 1B shows a side view of an embodiment of the left side 112 of the helmet 100. As such, the visor 116 and front 102 of the helmet 100 are shown at the left of the FIG. 1B while the rear of the helmet 104 is shown at the right of FIG. 1B. The segmented outer shell 150 comprises the first segment 156 shown in a U-shape 158 with the base 158 of the U-shape over the faceport 114 of the helmet 100, and the left leg 158*c* of the U-shape 158 first segment 156 extending longitudinally along the left side 112 of the helmet 110. The first segment 156 comprises a ridge 160 extending along the side 112 of the helmet as part of the hinged zone 178 to absorb shocks by deflecting towards the center 184 of the helmet or toward the head 94 of the user 90. The first segment 158 is coupled to the second segment, including the upper portion 172 and the lower portion 174 of the second segment 170 with the elastomeric material 190. FIG. 1B also shows that a strip or bend of elastomeric material 190 can also be disposed around, along, or at the lower edge or bottom portion 108 of the helmet 100.

Figure 1C:
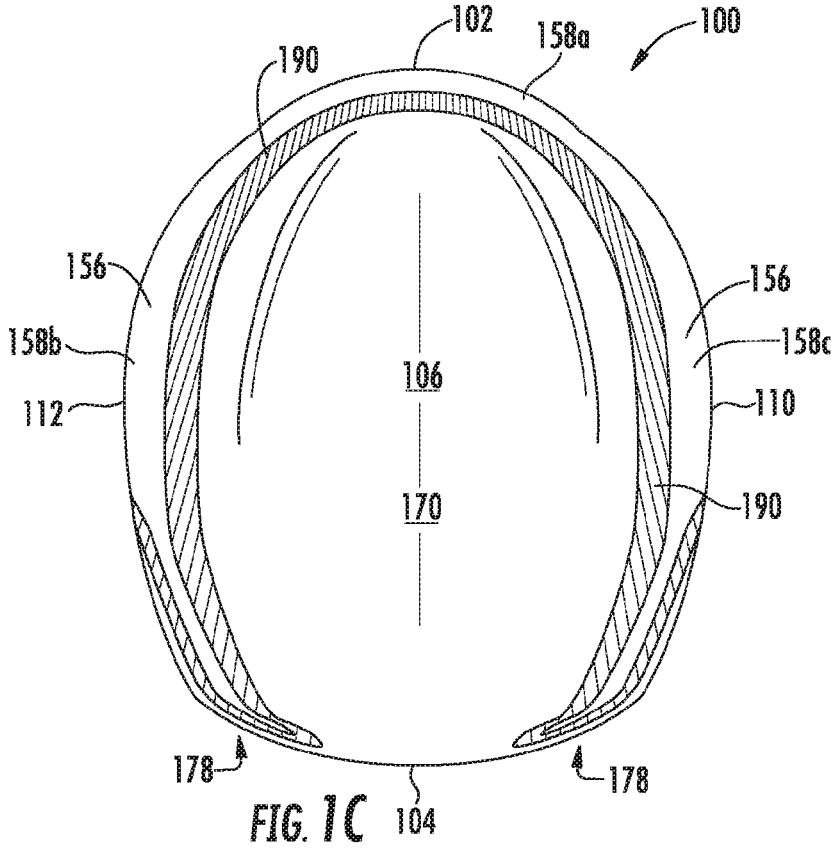

FIG. 1C shows a top or plan view of an embodiment of the helmet 100 shown from a direction that is transverse or perpendicular to an angle of the view of FIG. 1B. As such, the right side of the helmet 110 is shown at the right of the FIG. 1B while the left side 112 of the helmet 100 is shown at the left of FIG. 1C. The first segment 156, the ridges or longitudinal peaks 160, and the elastomeric material 190 are shown to circle around the crown or top 106 of the helmet 110 from the front of the helmet and extending continuously to the rear 104 of the helmet. The gap 164 between the first segment 156 and the second segment 170, as well as the elastomeric material 190, do not cross an entirety of the rear of the helmet 110, but are separated by an isthmus or connection portion 176 of the second segment 170 of the outer shell 110 that extends vertically from the upper portion 172 of the second segment 170 to the lower portion 174 of the second segment 170.

Figure 2A:
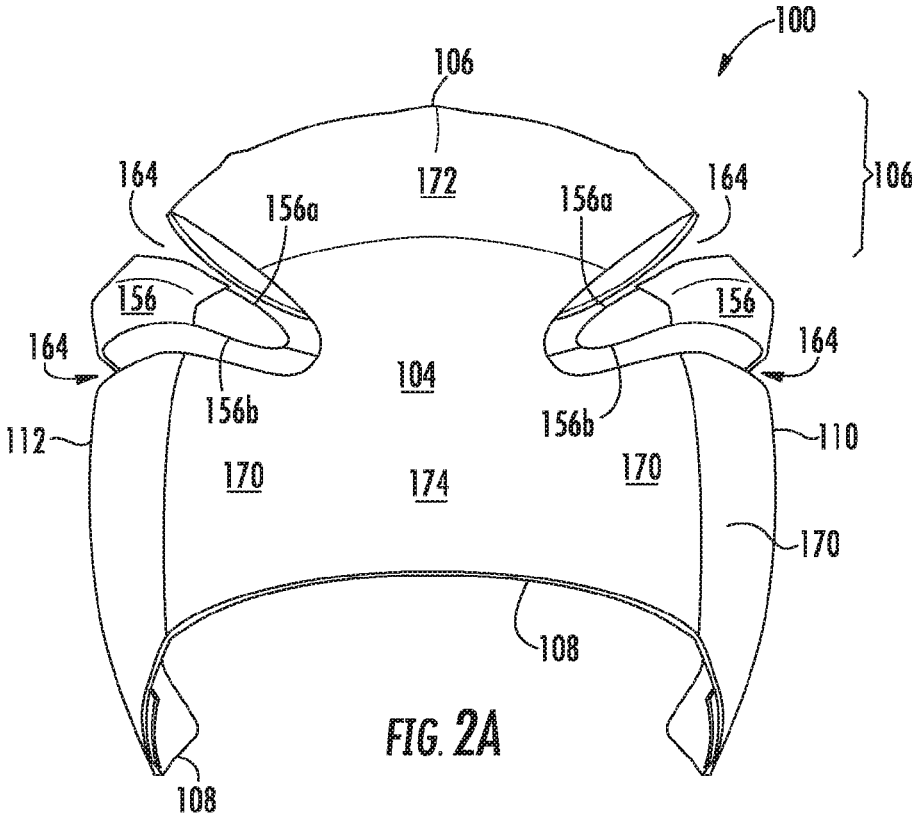
FIGS. 2A and 2B show various views of an embodiment of a shock absorbing helmet with a gap in the outer shell without an elastomeric material.

FIG. 2A shows an elevation or profile view of the rear 104 of the outer shell 150 of helmet 100. The outer shell 150 is shown without the elastomeric material 190 disposed within the opens zones, channels, or spaces 180 of the outer shell 150.

Figure 2B:
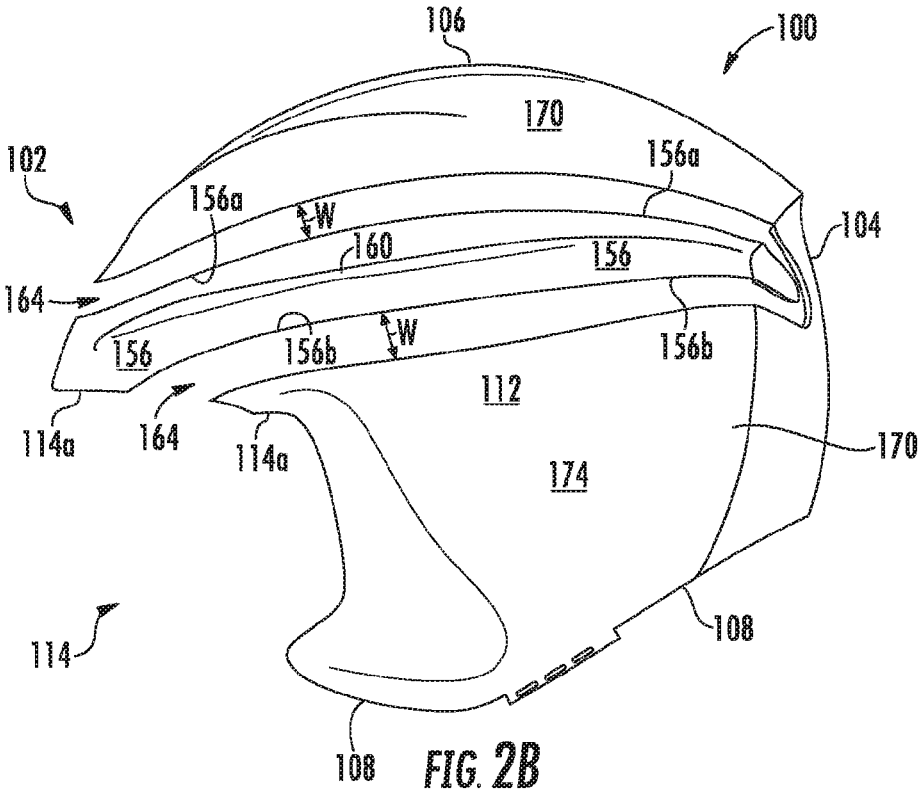

FIG. 2B shows a side or profile view of the left side 112 of the outer shell 150 of helmet 100. The outer shell 150 is shown without the elastomeric material 190 disposed within the opens zones, channels, or spaces 180 of the outer shell 150.

Figure 3A:
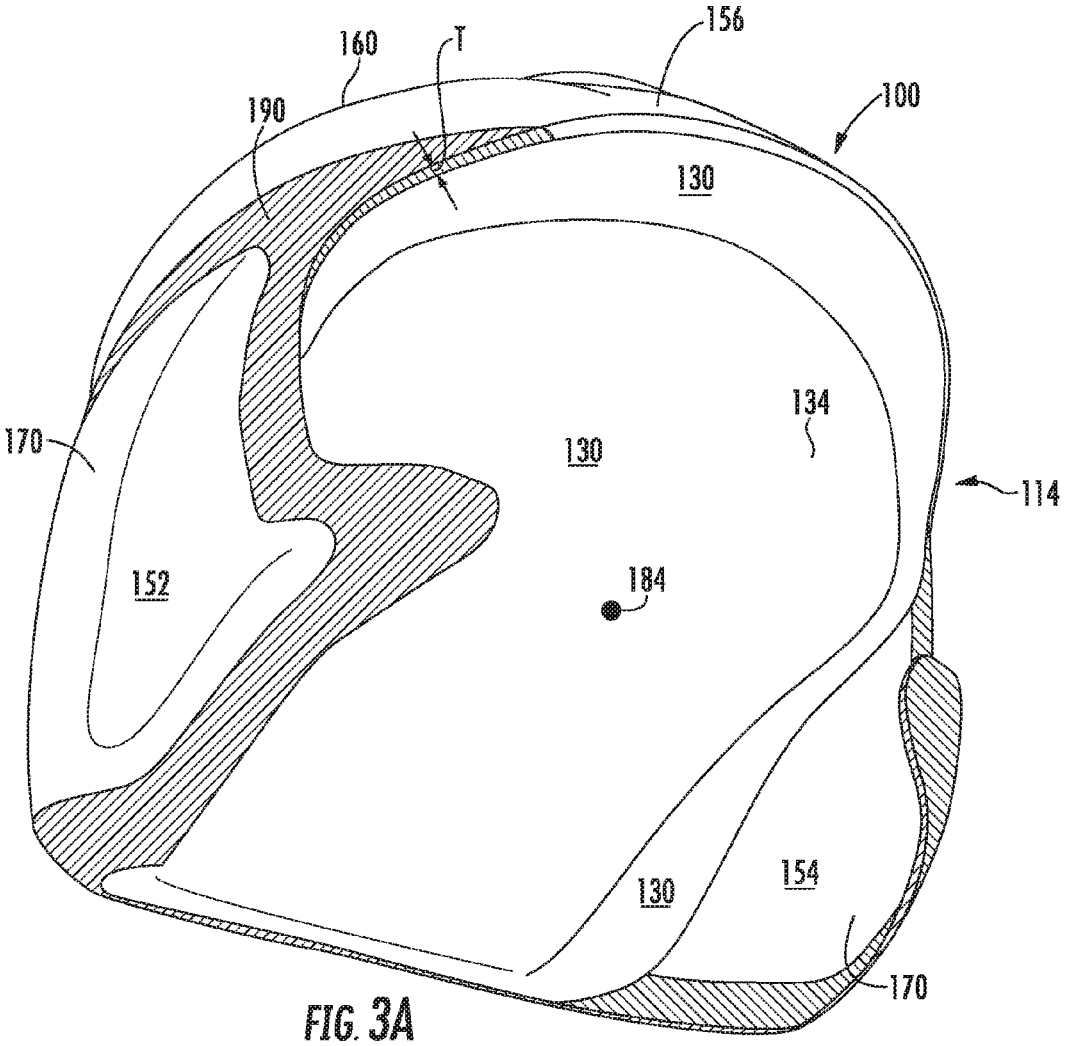
FIGS. 3A and 3B show various views of a position of an energy absorbing liner within an outer shell of an embodiment of a shock absorbing helmet.

FIG. 3A shows a perspective view of the bottom 108 front 102 and sides 110, 112 of the helmet 100 including first and second segments 156, 170 of the outer shell 150 coupled together with the elastomeric material 190. Additionally, the energy absorbing liner 130 is shown disposed within the outer shell 150, with the inner surface 134 of the absorbing liner 130 exposed. A center or centroid 134 of the helmet 100 is also shown within the interior space of the helmet configured or adapted to receive the head 94 of the user 90. In some instances, additional comfort padding or fit padding can be placed within the helmet 100 and can be coupled to the inner surface 134 of the layer 130. The comfort padding can comprise one or more of foam cushions, padding, textiles, or cloth, as well as a frame or support made of plastic or other suitable material. The energy absorbing layer can be attached, such as by adhesive or other suitably way, to only a portion of the outer shell 150, such as the second segment 170 of the helmet, so as to leave the first segment 156 free to move in and out relative to the energy absorbing liner 130.

Figure 3B:
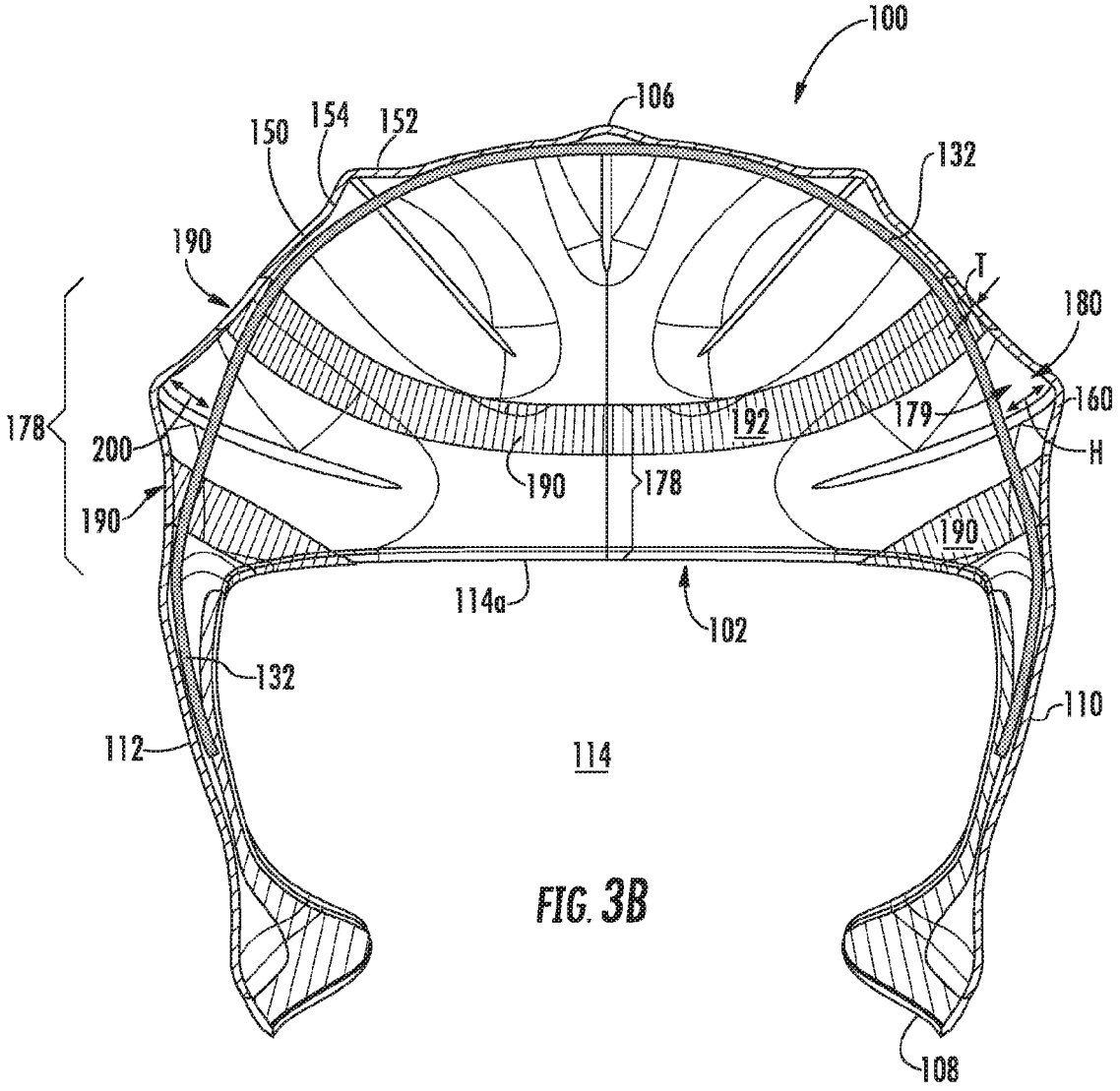

FIG. 3B shows a non-limiting embodiment of a cross-sectional view of the helmet 100 at an angle similar to the angle presented in FIG. 2A. However, in the cross-sectional view of FIG. 3B, removes the rear portion 104 of the helmet 100, showing the inner surfaces 154, 192 of the outer shell 150 and the elastomeric material 190, respectively, looking towards the front 102 of the helmet 100 of the faceport 114.

FIG. 3B also depicts a non-limiting embodiment of the helmet 100 comprising a plurality of elastomeric material strips 190 and a plurality of open zones 180. According to some aspects, each strip of elastomeric material 190 may comprise an elongated strip that extends continuously between edges of the helmet 100 or outer shell 150 of the helmet 100. In more particular embodiments, a strip of the elastomeric material 190 may be positioned between longitudinal peaks or ridges 160 of the outer shell 150, or the longitudinal peaks or ridges 160 of the outer shell 150 may be positioned between elastic material strips, or both. As used herein, longitudinal can denote extending lengthwise between the front 102 and the back 104 of the helmet 100. In the non-limiting embodiment shown in FIG. 3B, for example, side peaks 160 are formed on the right leg 158*b* and the left leg 158*c* of the first segment 156 of the hard outer shell 150, being positioned between, and coupled to, two strips of elastomeric material 190. The side peaks 160 on the outer shell 150 may extend further from the outer surface 152 than any of the other peaks. With the positioning of the peaks or ridges 160 proximate the sides 110, 112 of the helmet 100, and extending farther form the energy absorbing layer 130, the side peaks or ridges 160 are more likely to be a first point of contact between an object, such as a pole or ski gate, and the helmet 100. With the ridges or peaks 160 positioned between two strips of elastomeric material 190, or a single strip of material 190 that wraps around the peak 160 and the upper side 156*a* and lower side 156*b* of the first segment 156, the elastomeric material 190 is better able to absorb a force or energy from contact between the ski gate and the outer shell 150 of the helmet 100. Accordingly, it is contemplated that each longitudinal peak or ridge 160 may be positioned between and coupled to elastic material strips. Various embodiments of the helmet 100 may further comprise elastomeric material 190 proximate the lower or bottom portion 108 of the helmet 100.

As further shown in FIG. 3B, the helmet 100 may comprise open spaces or zones 180 positioned between the one or more longitudinal peaks 160 of the outer shell 150 and the outer surface 132 of the energy absorbing liner 130. For example, in the non-limiting embodiment shown in FIG. 3B, the helmet 100 comprises open zones 180 that extend between the strips or portions of elastomeric material 190 and between the energy absorbing material 130 and the peaks or ridges 160 of the outer shell 150. In one or more embodiments, an open zone may be positioned between a plurality, or all, of the ridges 160 of the outer shell 150 and the inner shell or energy absorbing material 130. The open zone 180 may be completely open and void of any material, or may be filled or partially filled with a rebounding filler material that absorbs, attenuates, or otherwise manages a force or energy applied to the outer shell 150 at the side peaks 160 and reforms once the force is no longer applied to the outer shell 150 at the side peaks 160. Alternatively, the open zone 180 can be empty, comprising gas or air at ambient pressure, to allow movement and spring like deformation of the outer shell 150 within the open zone 180 so the outer shell 150 can absorb or manage energy be deforming and returning to its at-rest position without contacting or substantially transferring energy to the energy absorbing liner 130, such as by direct contact. In some instances the open space 180 can be filled with pressurized air, such as within balloons or bladders, that can be adjusted to increase or decrease the force, pressure, or resistance required to deflect or deform the ridges 160 into the open zones 180.

According to some aspects, the open space 180 can also extend between the inner surface 192 of the elastomeric material 190 and the outer surface 132 of the energy absorbing liner 130 so that the elastomeric material 190 can flex inward towards the energy absorbing material 130 when the ridges 130 or a segment so the outer shell 150, like the first segment 156, receives a force or blow from a ski gate or other object. In combination with the elastomeric material 190 and the longitudinal peaks or ridges 160, the hinged zone or crumple zone 178 can receive a force that compresses (and/or stretches) the elastomeric material 190 and pushes the longitudinal peak or ridge 160 closer to the inner shell 130 without deforming the inner shell 130. When the force is removed from the longitudinal peak or ridge 160, the elastic material strip(s) 190 decompress (and/or relax) and return the longitudinal peak or ridge 160 to its original position spaced from the inner shell 130 of the helmet 100.

When desirable, vents or ventilation openings can also be formed through the helmet 100, including through the energy absorbing layer 130 and the outer shell 150. The vents can allow air and airflow from outside the helmet 100 move within the helmet and adjacent a head 94 of the user 90 to cool the user 90.

Where the above examples, embodiments and implementations reference examples, it should be understood by those of ordinary skill in the art that other helmet and manufacturing devices and examples could be intermixed or substituted with those provided. Accordingly, for example, although particular helmets may be disclosed, such components may comprise any shape, size, style, type, model, version, class, grade, measurement, concentration, material, weight, quantity, and/or the like consistent with the intended operation of a method and/or system implementation for a helmet may be used. In places where the description above refers to particular implementations of helmets, it should be readily apparent that a number of modifications may be made without departing from the spirit thereof and that these implementations may be applied to other helmets. Accordingly, the disclosed subject matter is intended to embrace all such alterations, modifications and variations that fall within the spirit and scope of the disclosure and the knowledge of one of ordinary skill in the art.

What is claimed is:

1. A helmet, comprising:

an outer shell comprising:

a faceport, a first segment comprising at least one longitudinal ridge extending from a front of the helmet to a rear of the helmet, a gap disposed along an edge of the first segment, the gap completely separating the first segment from an adjacent second segment of the outer shell;

an elastomeric material spanning the gap between the first segment and the second segment and fixedly attached to the first segment and the second segment of the outer shell thereby defining a hinged zone;

an energy absorbing helmet liner coupled to an inner surface of the outer shell; and an open space formed between an inner surface of the first segment and the elastomeric material, and an outer surface of the energy absorbing helmet liner;

wherein the first segment, due to elastic lengthening of the elastomeric material spanning the gap, is configured to recess into the open space formed between the inner surface of the first segment and the outer surface of the energy absorbing helmet liner when the first segment is impacted.

2. The helmet of claim 1, wherein the gap comprises a width in a range of 3-30 millimeters (mm) and provides an offset between an upper side of the first segment and an upper portion of the second segment, and provides an offset between a lower side of the first segment and a lower portion of the second segment.

3. The helmet of claim 1, wherein the first segment comprises a U-shape with a base of the U-shape extending along a top edge of the faceport and legs of the U-shape extend to the rear of the helmet along opposing right and left sides of the outer shell.

4. The helmet of claim 1, wherein the energy absorbing helmet liner comprises an inner surface oriented towards a space for receiving a head of a user and the outer surface of the energy absorbing liner is opposite the inner surface, the outer surface of the energy absorbing liner being directly attached to the second segment of the outer shell, and the outer surface of the energy absorbing liner being offset from an inner surface of the at least one longitudinal ridge by the open space.

5. The helmet of claim 1, wherein the hinged zone is configured to elastically extend to a greater width, the greater width being greater by an amount in a range of 1-20 mm through the open space towards the energy absorbing helmet liner to reduce energy transferred from the outer shell to the energy absorbing helmet liner.

6. The helmet of claim 1, wherein the at least one longitudinal ridge comprises at least two longitudinal ridges that each comprise peaks and the open space comprises a height in a range of 5-40 mm when at rest.

7. The helmet of claim 1, wherein the elastomeric material is formed as a strip comprising a thickness in a range of 1-10 mm.

8. A helmet, comprising:

an outer shell comprising a plurality of helmet segments extending from a front of the helmet to a rear of the helmet, the plurality of helmet segments including a first segment and a second segment completely offset from the first segment by a gap, a hinged zone formed between the first segment and the second segment by an elastomeric material filling the gap and coupled to the first segment and the second segment of the outer shell;

an energy absorbing liner disposed within and immediately adjacent an inner surface of the outer shell; and an open space formed between an inner surface of the first segment and an outer surface of the energy absorbing liner;

wherein the first segment, due to elastic lengthening of the elastomeric material, is configured to recess into the open space formed between the inner surface of the first segment and the outer surface of the energy absorbing helmet liner when the first segment is impacted.

9. The helmet of claim 8, wherein the gap comprises a width in a range of 3-30 mm and provides an offset between an upper side of the first segment and an upper portion of the second segment, and provides an offset between a lower side of the first segment and a lower portion of the second segment.

10. The helmet of claim 8, wherein the first segment forms a U-shape with a base of the U-shape extending along a top edge of a faceport of the outer shell and legs of the U-shape extending to the rear of the helmet along opposing right and left sides of the outer shell.

11. The helmet of claim 8, wherein the energy absorbing liner comprises an inner surface oriented towards a space for receiving a head of a user and the outer surface of the energy absorbing liner is opposite the inner surface, the outer surface of the energy absorbing liner being directly attached to the second segment of the outer shell, and the outer surface of the energy absorbing liner being offset from the inner surface of the first segment by the open space.

12. The helmet of claim 8, wherein the hinged zone is configured to elastically expand by an amount in a range of 1-20 mm towards the energy absorbing liner in a radial direction toward a center of the helmet to reduce energy transferred from low-energy impacts through the outer shell to the energy absorbing liner.

13. The helmet of claim 8, wherein a longitudinal ridge formed on the first segment of the outer shell comprises peaks and the open space comprises a height in a range of 5-40 mm when at rest.

14. The helmet of claim 8, wherein the elastomeric material is formed as a strip comprising a thickness in a range of 1-10 mm.

15. A helmet, comprising:

an outer shell;

a first outer shell segment laterally spaced away and completely separated from the outer shell by a gap between the first outer shell segment and the outer shell;

an elastomeric material extending continuously between the first outer shell segment and the outer shell and filling the gap to form a hinged zone between the outer shell and the first outer shell segment;

an energy absorbing liner coupled to an inner surface of the outer shell; and an open space formed between an inner surface of the first outer shell segment and an outer surface of the energy absorbing liner;

wherein the first segment, due to elastic lengthening of the elastomeric material, is configured to recess into the open space formed between the inner surface of the first segment and the outer surface of the energy absorbing helmet liner when the first segment is impacted.

16. The helmet of claim 15, wherein:

the first outer shell segment extends from a front of the helmet to a rear of the helmet;

the gap disposed along an edge of the first outer shell segment;

the outer shell further comprises a second outer shell segment offset from the first outer shell segment;

wherein the elastomeric material is disposed within the gap and is coupled to the first outer shell segment and the second outer shell segment.

17. The helmet of claim 16, wherein the first outer shell segment comprises a U-shape with a base of the U-shape extending along a top edge of a faceport of the outer shell and legs of the U-shape extending to the rear of the helmet along opposing right and left sides of the outer shell.

18. The helmet of claim 15, wherein the energy absorbing liner comprises a cellular material for absorbing maximum test standard energies upon accidental impact.

19. The helmet of claim 15, wherein the energy absorbing liner comprises an inner surface oriented towards a space for receiving a head of a user and the outer surface of the energy absorbing liner is opposite the inner surface of the energy absorbing liner, the outer surface of the energy absorbing liner being offset from the inner surface of the first segment of the outer shell by the open space, and the outer surface of the energy absorbing liner being directly attached to a second segment of the outer shell.

20. The helmet of claim 15, wherein the hinged zone comprises a ridge that is configured to elastically extend through the open space towards the energy absorbing liner to an additional distance within a range of 1-20 mm to reduce energy transferred from the outer shell to the energy absorbing liner.

* * * * *